US005315725A

United States Patent [19]

Vanden Heuvel

[11] Patent Number: 5,315,725

[45] Date of Patent: May 31, 1994

[54] MULTIPURPOSE TOOL

[76] Inventor: Martin K. Vanden Heuvel, R.R. #2, 207 Highway No. 5, Dundas, Ontario, Canada, L9H 5E2

[21] Appl. No.: 49,317

[22] Filed: Apr. 21, 1993

[51] Int. Cl.[5] ..... B25D 1/04

[52] U.S. Cl. ..... 7/145; 7/147; 30/123

[58] Field of Search ..... 7/145-147, 7/158; 30/123

[56] References Cited

U.S. PATENT DOCUMENTS 3,623,173 11/1971 Hagquist ..... 7/145

FOREIGN PATENT DOCUMENTS 94155 4/1959 Norway ..... 7/145

32797 11/1910 Sweden ..... 7/145

*Primary Examiner*—James G. Smith

*Attorney, Agent, or Firm*—S. Michael Bender

[57] ABSTRACT

A new and improved multipurpose hand-held tool, especially adapted to be used by rescue workers to extract victims from damaged motor vehicles, includes a handle, a head, a foot, and a saw blade that projects from the bottom of the foot. The head is connected to the handle and includes a first head end, a middle head portion, and a second head end. The foot, which is connected to the handle, includes a first foot end, a middle foot portion, a second foot end, and a bottom side. In a first embodiment, a first cutter, which is pyramidal shaped, is connected to the first head end and has a sharp, pointed edge. A second cutter is connected to the second head end and has a long, flat, axe blade. The first foot end includes a pointed hook edge, especially adapted for prying; and the second foot end includes a hammer head. In a second embodiment, a hammer head is connected to the first head end; and an axe head cutter is connected to the second head end. The first foot end includes a bifurcated claw with two pointed hooked tips, especially adapted for removing nails and prying; and the second foot end includes a pointed, pyramidal end. In both embodiments, the saw blade includes a toothed portion which projects from the bottom of the foot and also includes a portion that passes through the bottom side of the foot and into a slot in the handle to which it is secured by screws.

11 Claims, 8 Drawing Sheets

MULTIPURPOSE TOOL

BACKGROUND OF THE INVENTION

1. Field of the Invention

The present invention relates generally to hand-held tools used to pry or break glass and wood and metallic materials, and more particularly, to a tool especially adapted to break into motor vehicles in order to facilitate removal of accident victims.

2. Description of the Prior Art

Often times when motor vehicles undergo accidents, the motor vehicle bodies are bent and damaged so that doors and windows cannot be opened in the normal manner. In such cases, it is necessary for rescue personnel to break into the motor vehicle in order to treat and remove the accident victims.

In order to break into the damaged vehicle, it is often necessary to cut through metal. At other times in order to gain entry in the vehicle, it is necessary or desirable to break glass which is present in the windshield or side windows. Sometimes it is necessary or desirable to both cut metal and break glass.

One often used tool in the prior art for breaking into motor vehicles is the common axe. Although in some ways effective, there is often a very undesirable side effect that accompanies the use of an axe on window glass; and that is that the glass will shatter and spray over the victim and even over a rescue worker who may have already gotten inside the vehicle to tend to the victim. It would be desirable, therefore, if a tool were provided that reduces the amount of glass that may fall upon a victim and/or rescue worker when a glass window is broken.

Moreover, a damaged motor vehicle may present a variety of challenges to a person trying to gain entry into the damaged vehicle. Not only may it be necessary for glass to be broken, but it may also be necessary to pry apart vehicle parts. Cutting by swinging an axe blade may be carried out. At other times, the rescuer may prefer to make a small hole, as opposed to using an axe blade, for beginning a sawing operation. At still other times, a rescuer may prefer to use a blunt tool for, in essence, hammering.

In an emergency rescue situation, it would be difficult and very burdensome for a rescue worker to bring along an assemblage of separate tools for cutting, sawing, piercing, prying, and hammering. Being burdened with a plurality of tools to accomplish these separate functions could slow the rescuer down and undesirably tire the rescuer out. It would also be very inconvenient for a rescuer to place one tool down and pick up another tool in rapid succession at a rescue site. In this respect, it would be desirable if a rescuer had a single tool that could be used to carry out the plurality of functions such as cutting, sawing, piercing, prying, and hammering.

The prior art seems to be deficient in disclosing a single tool that would provide a rescuer with the plurality of functions mentioned above. For example, U.S. Pat. No. 3,680,834 of Holloway discloses a combined pry bar and nail puller, but this tool does not provide components to be used for cutting, sawing, piercing, or hammering. In U.S. Pat. No. 4,625,945 of Hearn et al, there is a disclosure of a pry bar wedge member, but neither does this tool provide elements to carry out the functions of cutting, sawing, piercing, or hammering.

U.S. Pat. No. 4,811,440 of Scott discloses a combination hood support, jack crank, lug wrench, and wheel cover apparatus. However, this combination tool does not provide means for cutting, sawing, piercing, or hammering as would be desirable for a rescue worker. U.S. Pat. No. 5,044,033 of Fosberg discloses a forcible entry tool which includes an elongate pry bar having at one end a cutting section which includes a pivoted gripping block and a cutting blade. The device disclosed in this patent is not designed for sawing, piercing, and hammering.

The following design patents disclose pry bars: U.S. Des. No. 277,359 of Schiller; and U.S. Des. No. 301,301 of Buckley. Neither of these designs discloses a tool that can perform all of the functions of cutting, sawing, piercing, prying, and hammering that may be necessary in a rescue operation.

Thus, while the foregoing body of prior art indicates it to be well known to use hand tools for cutting and prying, the provision of a simple and cost effective device is not contemplated which can perform all of the operations of cutting, sawing, piercing, prying, and hammering in a single tool. The foregoing disadvantages are overcome by the unique multipurpose tool of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved multipurpose hand-held tool, especially adapted to be used by rescue workers to extract victims from damaged motor vehicles, and this tool includes a handle, a head, a foot, and a saw blade that projects from the bottom of the foot. The head is connected to the handle and includes a first head end, a middle head portion, and a second head end. The foot, which is connected to the handle, includes a first foot end, a middle foot portion, a second foot end, and a bottom side.

In a first embodiment, a first cutter, which is pyramidal shaped, is connected to the first head end and has a sharp, pointed edge which is especially adapted to puncture through glass windshields. A second cutter is connected to the second head end and has a long, flat, axe-like blade and performs functions similar to that of an axe. The first foot end includes a pointed hook edge, especially adapted for prying; and the second foot end includes a hammer head that can be used as a conventional hammer.

In a second embodiment, a hammer head is connected to the first head end. An axe head cutter is connected to the second head end and has an axe blade and performs functions similar to that of an axe. The first foot end includes a bifurcated claw having two pointed hooked tips, especially adapted for removing nails and for prying; and the second foot end includes a pointed, pyramidal end that can be used which is especially adapted to puncture through glass windshields.

In both embodiments, the saw blade includes a toothed portion which projects from the bottom of the foot and also includes a portion that passes through the bottom side of the foot and into a slot in the handle to which it is secured by screws.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be covered by the claims appended hereto.

In this respect, before explaining a preferred embodiment of the multipurpose tool of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved multipurpose tool which has all of the advantages of the prior art and none of the disadvantages.

It is another object of the present invention to provide a new and improved multipurpose tool which may be easily and efficiently manufactured and marketed.

It is a further object of the present invention to provide a new and improved multipurpose tool which is of durable and reliable construction.

An even further object of the present invention is to provide a new and improved multipurpose tool which is susceptible of a low cost of manufacture with regard to both materials and labor, and which accordingly is then susceptible of low prices of sale to the consuming public, thereby making such multipurpose tool available to the buying public.

Still yet a further object of the present invention is to provide a new and improved multipurpose tool that reduces the amount of glass that may fall upon a victim and/or rescue worker when a glass window is broken in rescuing a victim from a motor vehicle.

Yet another object of the present invention is provide a rescuer with a single tool that could be used to carry out the plurality of functions such as cutting, sawing, piercing, prying, and hammering in a rescue operation.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
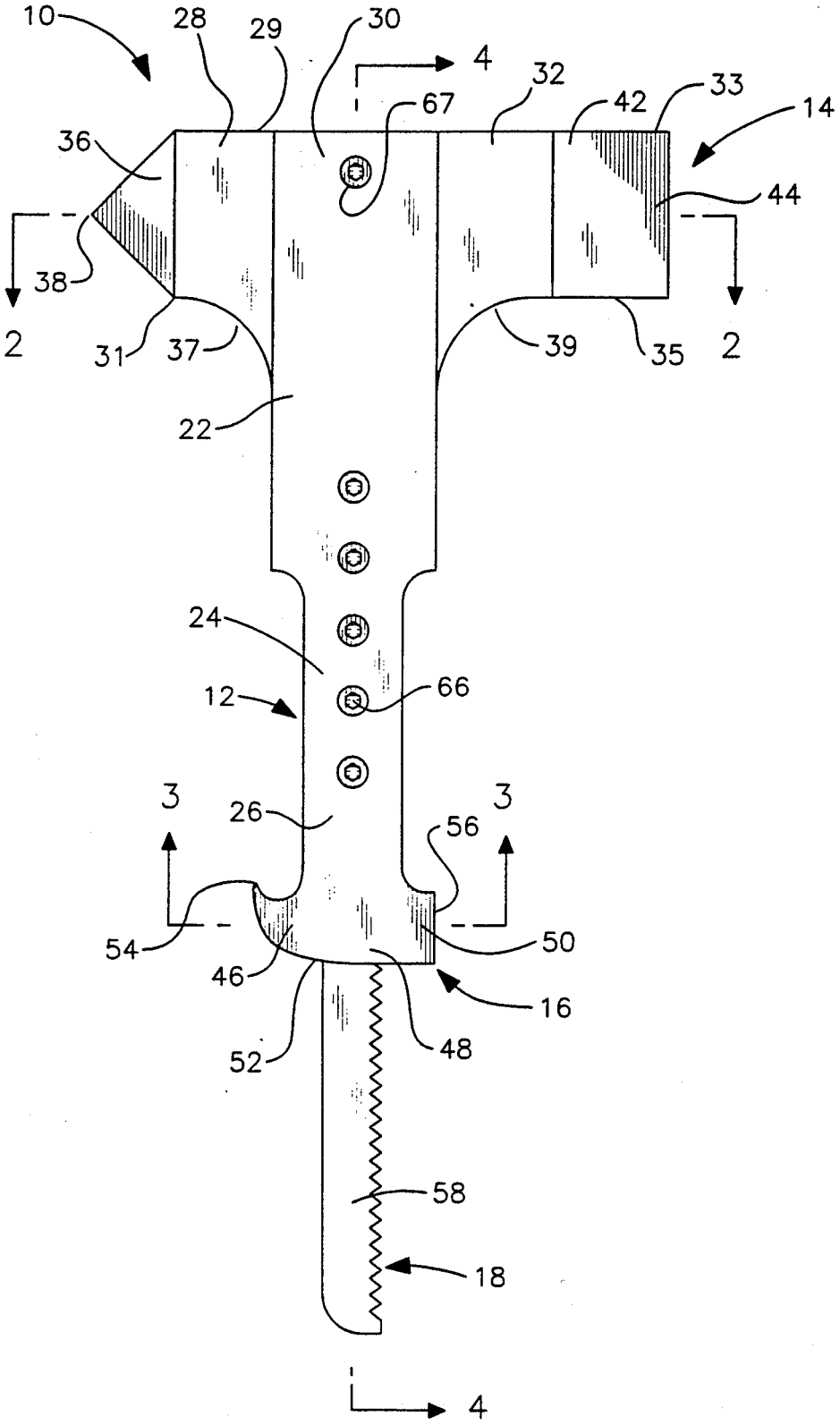
FIG. 1 is an elevation view showing a first preferred embodiment of the multipurpose tool of the invention.

With reference to the drawings, a new and improved multipurpose tool embodying the principles and concepts of the present invention will be described.

Turning initially to FIGS. 1-5, there is shown a first preferred embodiment of the multipurpose tool of the invention generally designated by reference numeral 10. In its preferred form, multipurpose tool 10 includes a handle 12, a head 14, a foot 16, and a saw blade 18 that projects from the bottom 20 of the foot 16.

The handle 12 includes an upper handle portion 22, a middle handle portion 24, and a lower handle portion 26 where the middle handle portion 24 is grasped by a hand of a user.

The head 14 includes a first head end 28, a middle head portion 30, and a second head end 32. The middle head portion 30 is connected to the upper handle portion 22. The first head end 28 has a topside 29 and a bottom side 31. The second head end 32 has a top side 33 and a bottom side 35. A first cutter 36, which is pyramidal shaped, is connected to the first head end 28 at a location 40 which is centrally located between the top side 29 and the bottom side 31 of the first head end 28. The first cutter 36, which is pyramidal shaped, has a sharp, pointed edge 38 and is especially adapted to puncture through glass windshields.

A second cutter 42 is connected to the second head end 32 at a location spanning from the top side 33 to the bottom side 35 of the second head end 32. The second cutter 42 has a long, flat, axe-like blade 44 and performs functions similar to that of an axe. The axe-like blade 44 is readily capable of cutting through metal.

The foot 16 includes a first foot end 46, a middle foot portion 48, a second foot end 50, and a bottom side 52. The middle foot portion 48 is connected to the lower handle portion 26. The first foot end 46 includes a pointed foot edge 54, especially adapted for prying; and the second foot end 50 includes a hammer head 56 that can be used as a conventional hammer.

As shown in FIGS. 1, 4, 5, 6, 9, and 10, the saw blade 18 includes a sawing portion 58 which projects from the bottom 52 of the foot 16 and also includes a connecting portion 62 that passes through the bottom side 52 of the foot 16 and into a slot 64 in the handle 12.

In the first embodiment of the invention shown in FIGS. 1–5, screws 65 with Allen heads pass through holes 67 in the handle 12 and holes in the saw blade 18 to secure the saw blade 18 to the tool 10. In the second embodiment of the invention shown in FIGS. 6–10, thumb screws 88 pass through holes 67 in the handle 12 and holes in the saw blade 18 to secure the saw blade 18 to the tool 10.

Figure 2:
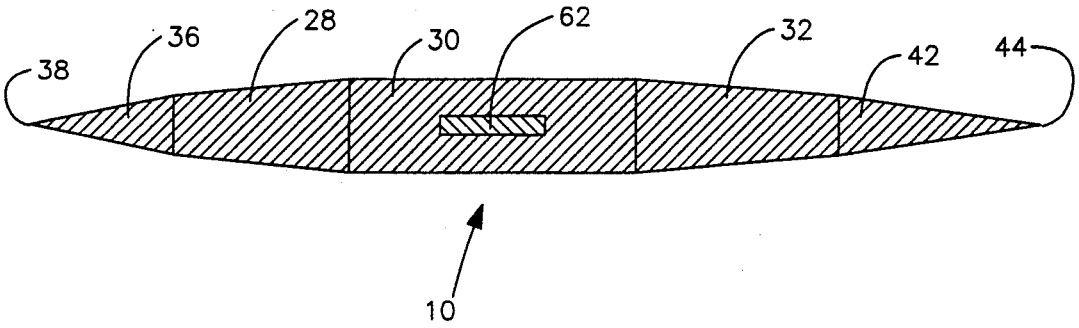
FIG. 2 is a cross-sectional view of the embodiment of the multipurpose tool of the invention shown in FIG. 1 taken along line 2—2.
Figure 3:
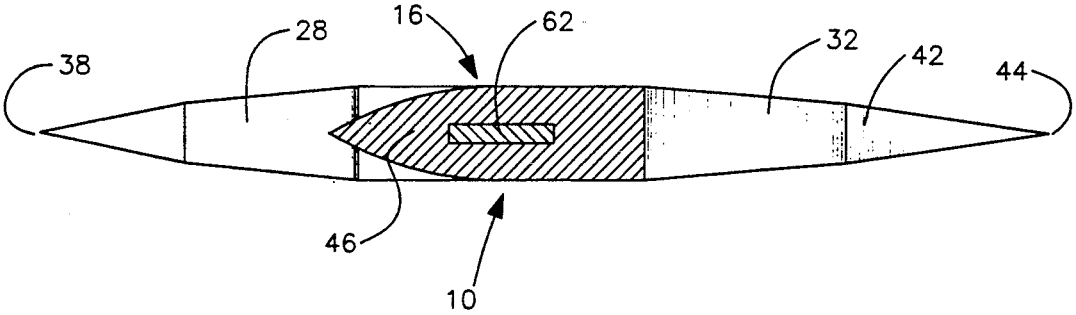
FIG. 3 is a cross-sectional view of the embodiment of the multipurpose tool of the invention shown in FIG. 1 taken along line 3—3.
Figure 4:
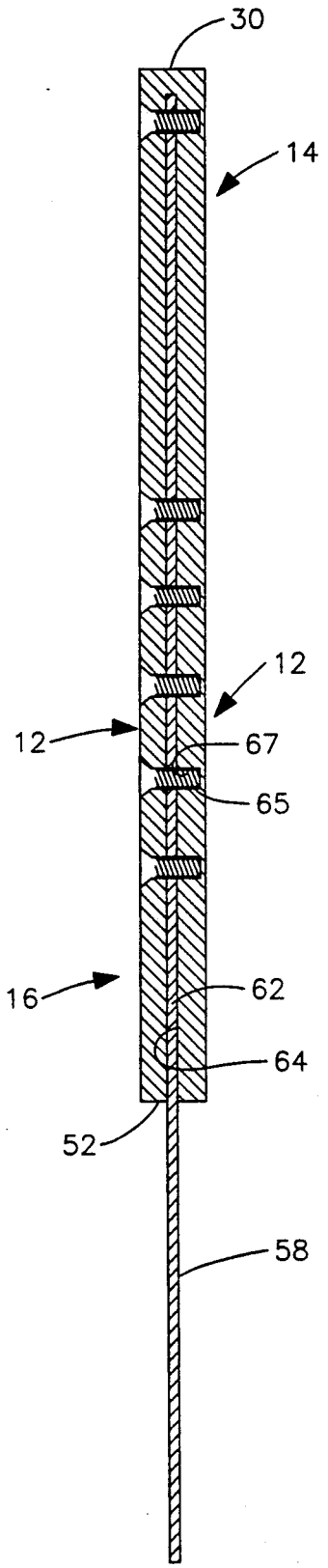
FIG. 4 is a cross-sectional view of the embodiment of the multipurpose tool of the invention shown in FIG. 1 taken along the line 4—4.
Figure 5:
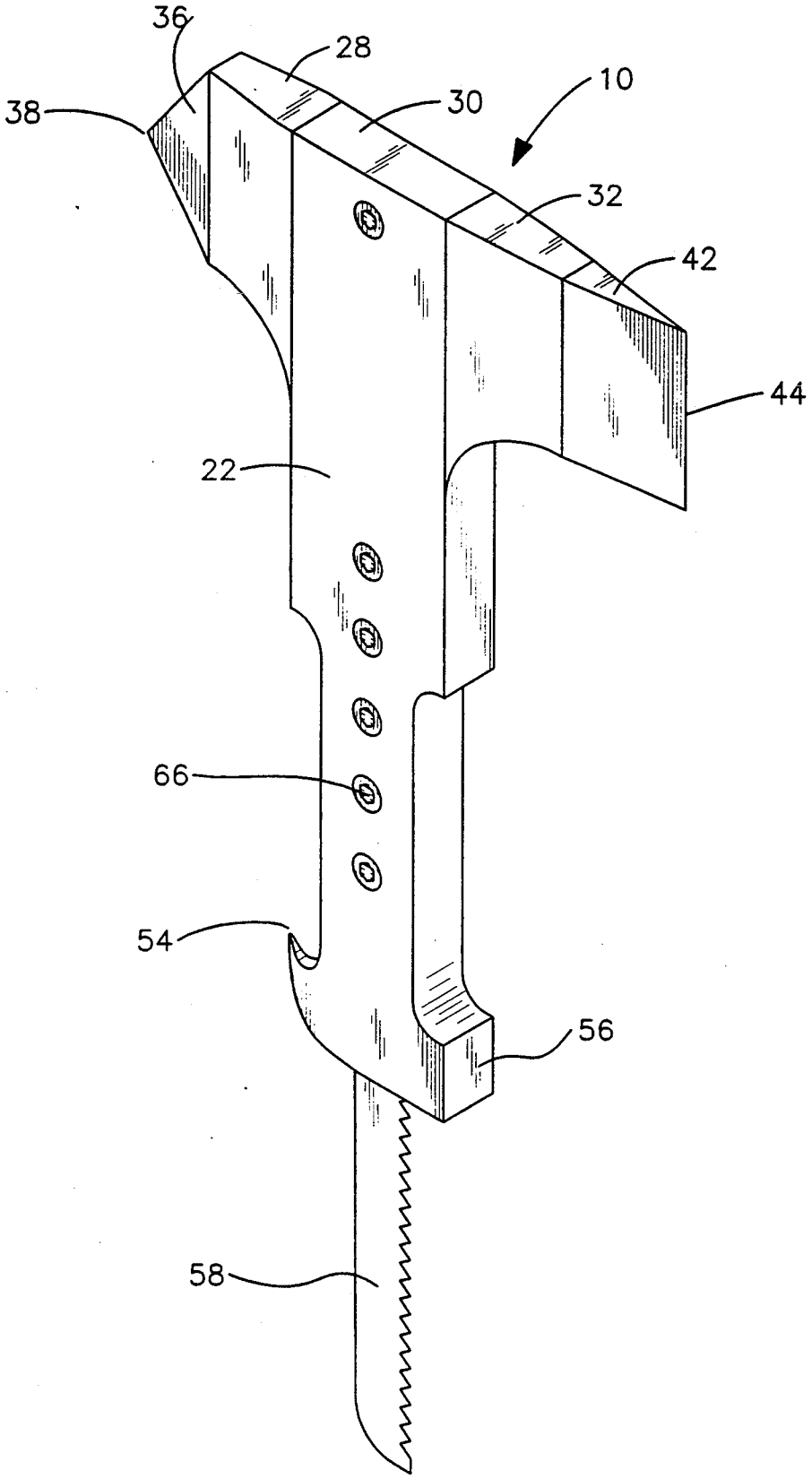
FIG. 5 is a perspective view of the embodiment of the invention shown in FIG. 1.
Figure 6:
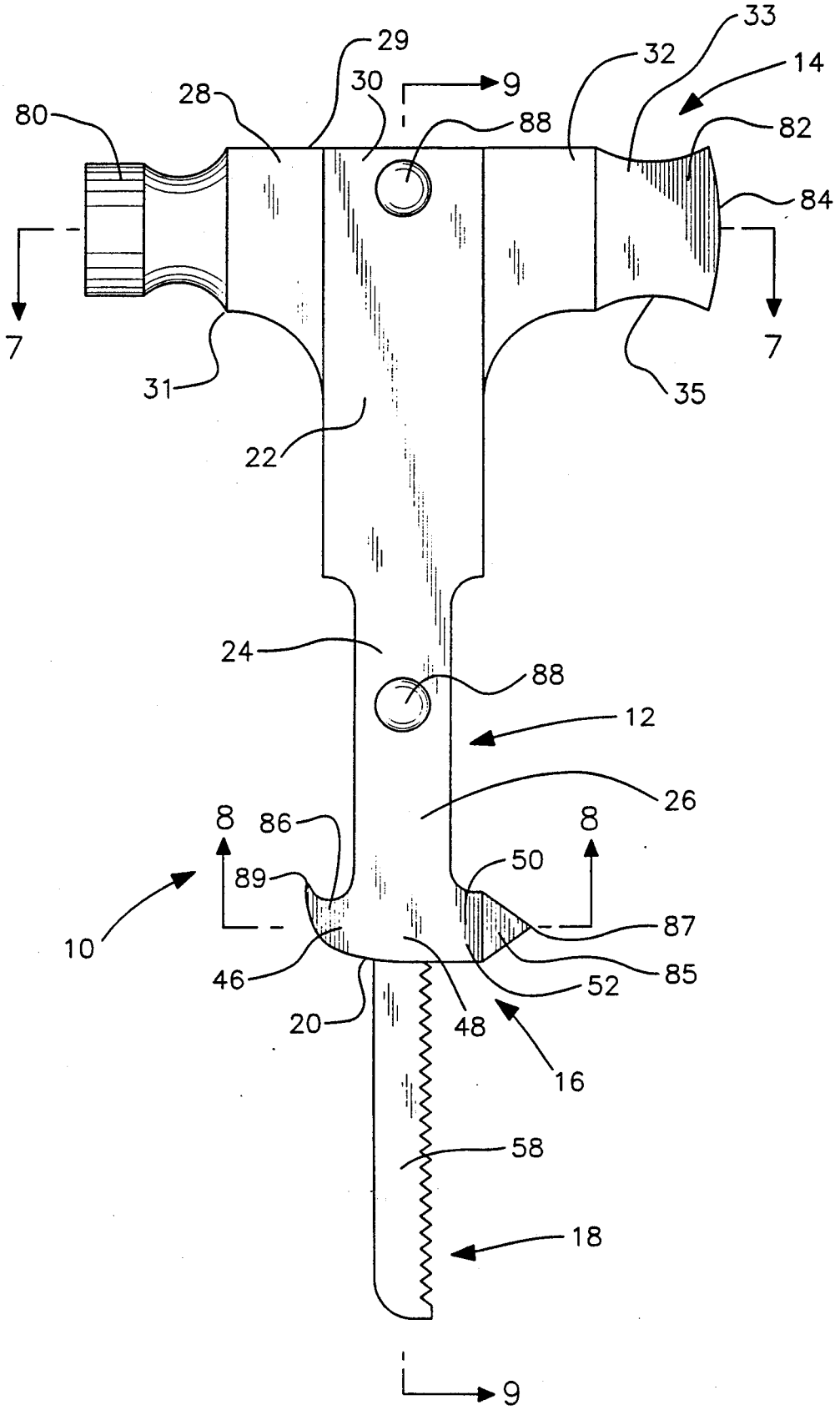
FIG. 6 is an elevation view of a second preferred embodiment of the multipurpose tool of the invention.
Figure 7:
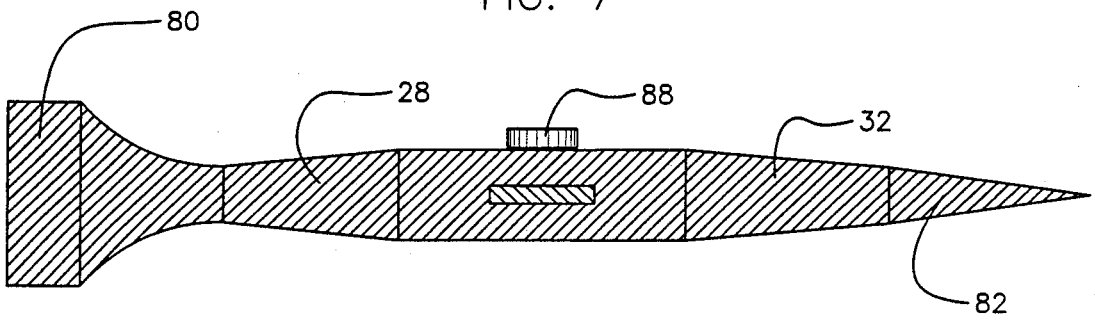
FIG. 7 is a top view of the second embodiment of the invention shown in FIG. 6.
Figure 8:
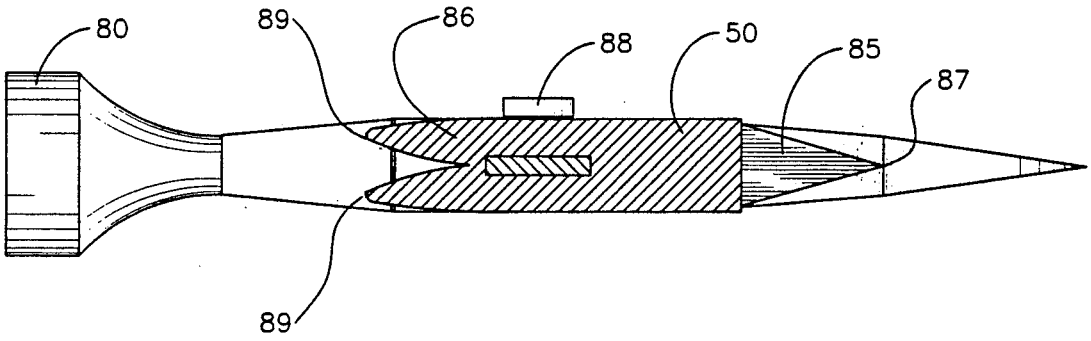
FIG. 8 is a bottom view of the second embodiment of the invention shown in FIG. 6.
Figure 9:
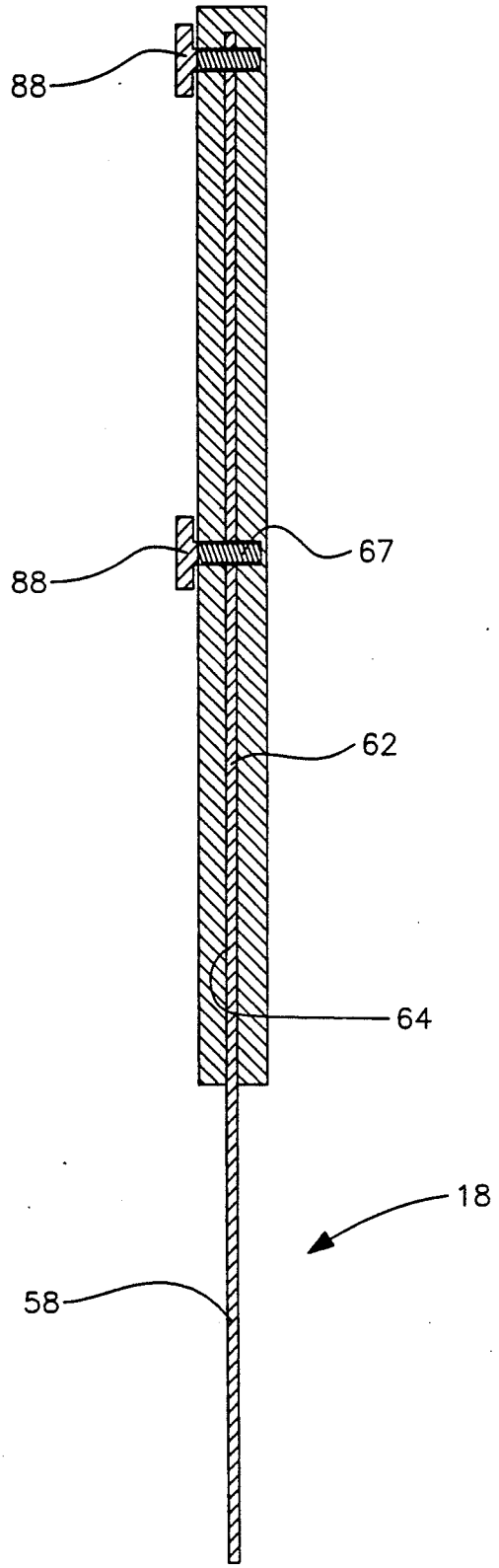
FIG. 9 is a cross-sectional view of the embodiment of the invention shown in FIG. 6 taken along the line 9—9 thereof.
Figure 10:
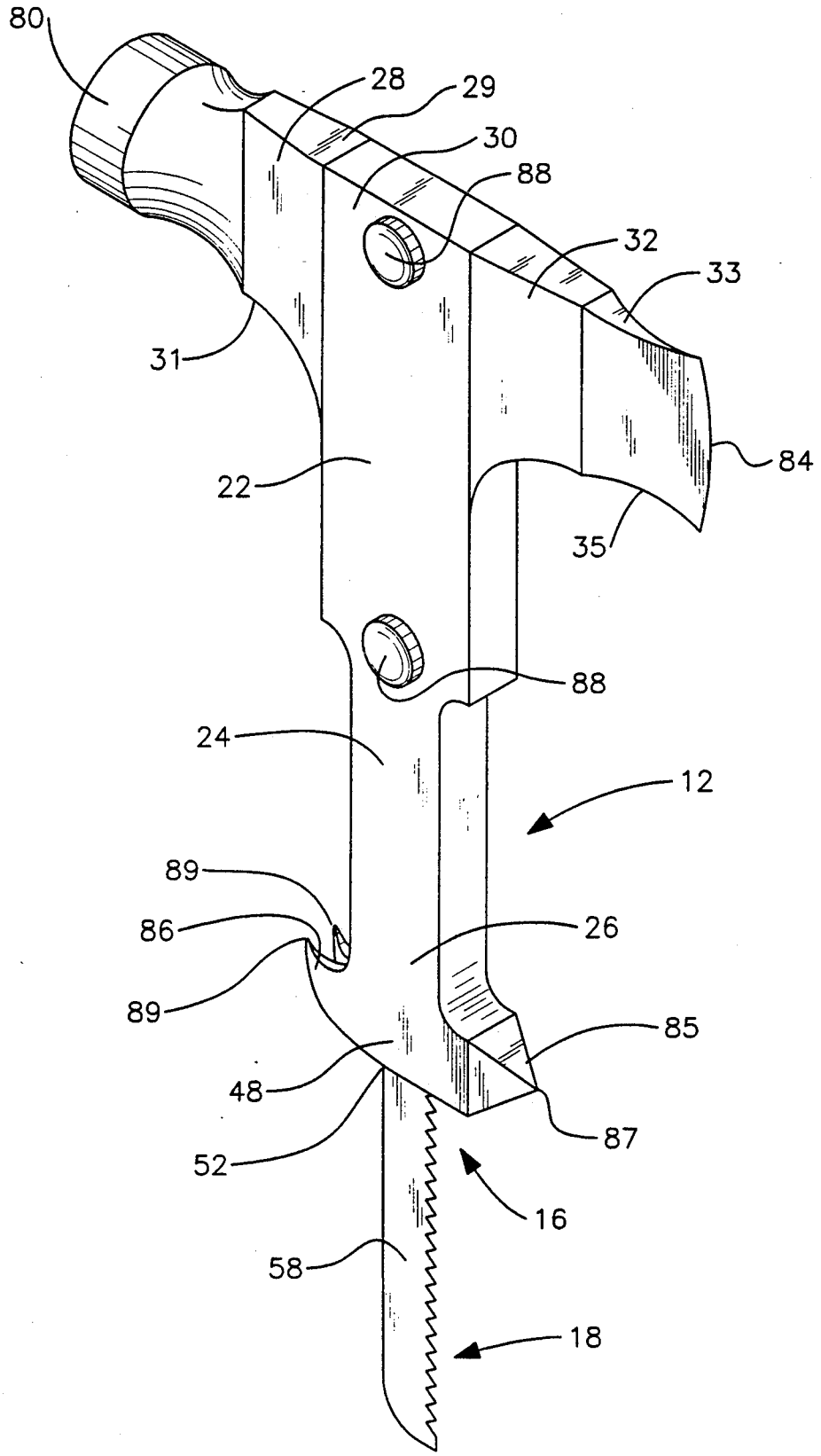
FIG. 10 is a perspective view of the second embodiment of the invention shown in FIG. 6.

The views shown in FIGS. 2 and 3 further illustrate the first preferred embodiment of the multipurpose tool 10 of the invention.

Turning to FIGS. 6–10, there is shown a second preferred embodiment of the multipurpose tool of the invention generally designated by reference numeral 10. In this preferred form, multipurpose tool 10 includes a handle 12, a head 14, a foot 16, and a saw blade 18 that projects from the bottom 20 of the foot 16.

The handle 12 includes an upper handle portion 22, a middle handle portion 24, and a lower handle portion 26 where the middle handle portion 24 is grasped by a hand of a user.

The head 14 includes a first head end 28, a middle head portion 30, and a second head end 32. The middle head portion 30 is connected to the upper handle portion 22. The first head end 28 has a topside 29 and a bottom side 31. The second head end 32 has a top side 33 and a bottom side 35. A conventionally-shaped hammerhead 80 is connected to the first head end 28.

An axe head cutter 82 is connected to the second head end 32 at a location spanning from the top side 33 to the bottom side 35 of the second head end 32. The axe head cutter 82 has an axle blade 84, with a curved top side 33 and a curved bottom side 35, and performs functions similar to that of an axe. The axe blade 84 is readily capable of cutting through metal.

The foot 16 includes a first foot end 46, a middle foot portion 48, a second foot end 50, and a bottom side 52. The middle foot portion 48 is connected to the lower handle portion 26. The first foot end 46 includes a bifurcated claw end 86 having two pointed hooked tips 89 for pulling nails and for prying; and the second foot end 50 includes pyramidal-shaped end 85 that has a pointed tip 87.

As mentioned above, the embodiments of the multipurpose tool 10 of the present invention are especially useful to rescue workers who wish to enter damaged motor vehicles involved in accidents and to extract victims from the motor vehicles. The pointed edge 38 can be in the form of a pointed tip which can be used to pierce a hole in a windshield to provide an opening for a saw blade 18. The saw blade 18 can be stored in the interior slot 64 of the handle 12 until ready for use.

Preferably, the saw blade 18 has its teeth pointing toward the handle 12 so that when glass is cut by the saw blade 18, pieces of glass will tend to be moved toward the person using the tool and doing the cutting and away from the windshield being sawed and therefore away from any victim trapped inside the motor vehicle and away from any emergency personnel who may be treating the victim. In this respect, it would be desirable for the person who is doing the sawing to wear full eye protection and gloves to be protected from flying glass.

It is noted that the first foot end 46 and the second foot end 50 can serve as a hand guard to protect a person's hand while gripping the handle 12 when using the saw blade 18. In addition, bottom curved portions 37 and 39 are provided to increase the strength of the multipurpose tool of the invention.

The axe-like edge 44 of the first embodiment and the axe head cutter 82 of the second embodiment can be used to penetrate steel on car bodies and can be used break windows and pry off hub caps and trim. Also, the axe-like edge 44 can also be used to make holes or spaces in door frames for inserting another tool which includes expandable jaws and which is called "jaws for life". The pointed foot edge 54 of the first embodiment is in the form of a hook that is especially useful as a pry hook for prying and pulling off chrome trim.

The slot 64 that receives the saw blade 18 can be formed by machining it into a steel plate. Alternatively, the middle handle portion 24 can include a removable plate that can be used to secure the saw blade 18 to the handle 12. As another alternative, the handle 12 can be welded together instead of being screwed. The saw blade 18 can be a heavy duty hacksaw blade. The head, the handle, and the foot can be fabricated from a hard metal (such as stainless steel) and be formed into a unified, integrated structure.

It is apparent from the above that the present invention accomplishes all of the objects set forth by providing a new and improved multipurpose tool that is low in cost, relatively simple in design and operation, and which may advantageously be used by a rescue worker that reduces the amount of glass that may fall upon a victim and/or another rescue worker when a glass window is broken and a may provide a rescuer with a single tool that could be used to carry out the plurality of functions of cutting, sawing, piercing, prying, and hammering.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved multipurpose hand-held tool, comprising:

a handle including an upper handle portion, a middle handle portion, and a lower handle portion, said middle handle portion for being grasped by a hand;

a head including a first head end, a middle head portion, and a second head end, said middle head portion connected to said upper handle portion, said first head end and said second head end having a respective top side and a bottom side;

a foot including a first foot end, a middle foot portion, a second foot end, and a bottom side, said middle foot portion connected to said lower handle portion;

a hammer head connected to either said head or said foot of said multipurpose tool;

a pyramidal shaped cutter connected to said foot of said multipurpose tool if said hammer head is connected to said head of said multipurpose tool, or said pyramidal shaped cutter connected to said head of said multipurpose tool if said hammer head is connected to said foot of said multipurpose tool;

a saw blade including a sawing portion and a connecting portion, said saw blade sawing portion projecting from said foot bottom side, and said saw blade connecting portion passing through said foot bottom side and connected to said handle, and means, passing through said handle, for securing said saw blade connecting portion to said handle.

2. The tool described in claim 1 wherein:

said hammer head is connected to said head of said multipurpose tool, and said pyramidal shaped cutter is connected to said foot of said multipurpose tool.

3. The tool described in claim 2 wherein:

said hammer head is connected to said first head end of said multipurpose tool, and said pyramidal shaped cutter is connected to said second foot end of said multipurpose tool.

4. The tool described in claim 3, further including:

an axe head cutter connected to said second head end of said multipurpose tool, and a bifurcated claw, including two pointed hooked tips, connected to said first foot end of said multipurpose tool.

5. The tool described in claim 4 wherein said axe head cutter includes a cutting edge spanning from said top side to said bottom side of said second head end.

6. The tool described in claim 1 wherein:

said hammer head is connected to said foot of said multipurpose tool, and said pyramidal shaped cutter is connected to said head of said multipurpose tool.

7. The tool described in claim 6 wherein:

said hammer head is connected to said second foot end of said multipurpose tool, and said pyramidal shaped cutter is connected to said first head end of said multipurpose tool.

8. The tool described in claim 7, further including:

a pointed foot edge connected to said first foot end of said multipurpose tool, and an axe blade connected to said second head end of said multipurpose tool.

9. The tool described in claim 1 wherein said middle foot portion, said lower handle portion, and said middle handle portion include slot means for receiving said saw blade connecting portion.

10. The tool described in claim 1 wherein said head, said handle, and said foot form a unified, integrated structure.

11. The tool described in claim 1 wherein said means for securing said saw blade connecting portion to said handle include thumb screws.

* * * * *